United States Patent [19]

Hossack

[11] Patent Number: 4,695,986

[45] Date of Patent: Sep. 22, 1987

[54] ULTRASONIC TRANSDUCER COMPONENT AND PROCESS FOR MAKING THE SAME AND ASSEMBLY

[75] Inventor: James M. Hossack, Redmond, Wash.

[73] Assignee: Ultrasonic Arrays, Inc., Woodinville, Wash.

[21] Appl. No.: 716,988

[22] Filed: Mar. 28, 1985

[51] Int. Cl.[4] ..... H04R 1/02; H04R 31/00

[52] U.S. Cl. ..... 367/140; 29/594

[58] Field of Search ..... 310/313 B, 313 R, 322, 310/334, 337, 340, 348, 349, 351, 352, 363, 366, 369, 301, 306; 367/140, 142, 151, 103, 108; 29/572, 590, 591, 594, DIG. 2; 250/375, 492.2, 504 R

[56] References Cited

U.S. PATENT DOCUMENTS

| | | | |
|---|---|---|---|
| 2,289,950 | 7/1942 | Wolfskill | 310/351 X |
| 3,825,779 | 7/1974 | de Klerk | 310/313 B |
| 3,940,638 | 2/1976 | Terayama | 310/348 |
| 4,025,954 | 5/1977 | Bert | 310/313 D |
| 4,081,626 | 3/1978 | Muggli et al. | 367/140 X |
| 4,118,649 | 10/1978 | Shwartzman | 310/334 X |
| 4,243,960 | 1/1981 | White et al. | 310/313 R X |
| 4,510,410 | 4/1985 | Yuhova et al. | 310/313 D |
| 4,516,049 | 5/1985 | Mikoshiba et al. | 310/313 B X |

OTHER PUBLICATIONS

Kuhl et al., Acustica Publication: "Condenser Transmitters and Microphones . . . ", vol. 4, No. 5, 1954, pp. 519–532.

*Primary Examiner*—Deborah L. Kyle
*Assistant Examiner*—Brian S. Steinberger
*Attorney, Agent, or Firm*—Flehr, Hohbach, Test, Albritton & Herbert

[57] ABSTRACT

Ultrasonic transducer assembly having a piston with a substantially planar surface formed of a conducting material. An insulating foil element having first and second surfaces overlying the substantially planar surface of the piston. The foil has a conducting layer carried by the first surface. A plurality of spaced apart support elements are disposed between the substantially planar surface of the piston and the second surface of the foil.

6 Claims, 3 Drawing Figures

ULTRASONIC TRANSDUCER COMPONENT AND PROCESS FOR MAKING THE SAME AND ASSEMBLY

This invention relates to an ultrasonic transducer component and a process for making the same and for an assembly thereof.

In co-pending application Ser. No. 532,576 filed on Sept. 15, 1983, there is disclosed an ultrasonic transducer therein which has a conducting planar surface which has been roughened. However, it has been found that there is difficulty in obtaining uniformity in the roughened surfaces and particularly from one transducer to the next. There is therefore a need for a new and improved component for the ultrasonic transducer.

In general, it is an object of the present invention to provide an transducer assembly with a transducer component which is provided with an improved roughened surface.

Another object of the invention is to provide a relatively simple process for making the transducer component.

Another object of the invention is to provide a transducer assembly utilizing such a component which has improved frequency capabilities.

Additional object features of the invention will appear from the following description in which the preferred embodiment is set forth in detail in conjunction with the accompanying drawings.

In general, the ultrasonic transducer assembly of the present invention is comprised of a piston or metallic disk having a substantially planar surface which is formed of a conducting material. It also consists of an insulating foil element or dielectric film having a surface of a conducting material overlying the substantially planar surface of the piston or metallic disk. A plurality of spaced apart support elements formed of a conducting or an insulating material are disposed between the substantially planar surface of the piston and the surface of the foil.

Figure 1:
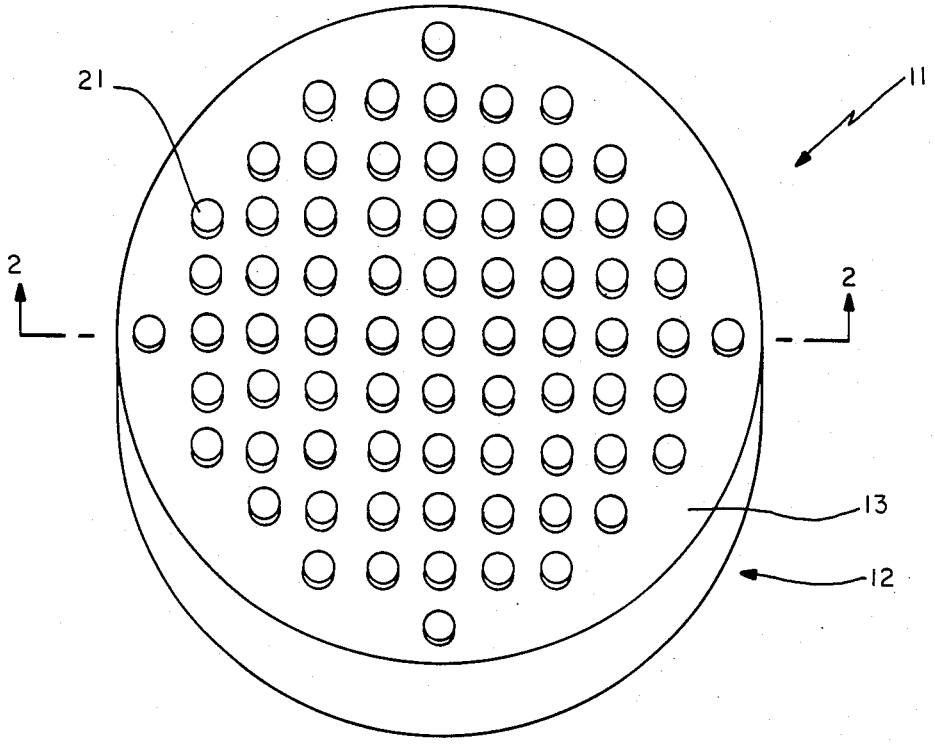
FIG. 1 is an isometric view of an ultrasonic transducer assembly incorporating the present invention.
Figure 2:
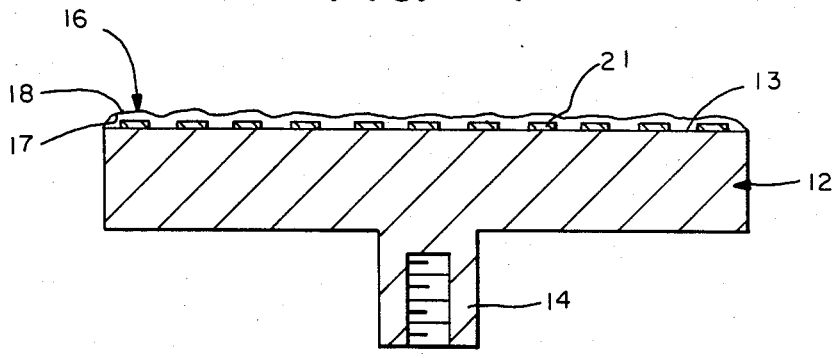
FIG. 2 is a cross-sectional view taken along the line 2—2 of FIG. 1.
Figure 3:
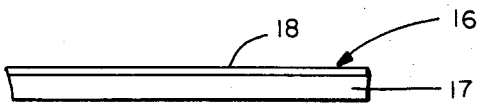
FIG. 3 is an enlarged cross-sectional view of a portion of the film shown in FIG. 2.

More particularly as is shown in FIG. 1 and 2 of the drawings, the transducer assembly 11 consists of a piston or metallic disk 12. It is formed of a suitable conducting material such as aluminum. It can be seen that the piston or metallic disk 12 is in the form of a right circular cylinder and is provided with a substantially planar surface 13 and with a centrally disposed rearwardly stud 14 which is used solely for attaching an electrical wire as hereinafter described. The surface 13 should be polished so that the surface irregularities are less than 1 micron high.

The attached transducer assembly 11 also includes an insulating foil element or dielectric film 16. The foil element 16 can be of a conventional type. It is provided with an insulating layer of a suitable material such as Kapton film 17 having first and second surfaces which overlie the piston or metallic disk 12. A conducting layer of gold 18 is disposed on the first or outer surface thereof by suitable means such as by evaporation to a suitable thickness as, per example, 350 angstroms plus or minus 50%. The second surface of foil element 16 overlies and faces the surface 13 of the piston or metallic disk 12.

Means is provided for supporting the foil 16 in a spaced-apart relationship from the substantially planar surface 13 of the piston or metallic disk 12 and consists of a plurality of spaced apart support elements 21. In order that the transducer assembly emit ultrasonic energy at a relatively uniform frequency over the planar surface 13, it is desirable that the spacing between the support elements 21 by relatively uniform and also that the support elements have a relatively uniform height. It is also desirable that the support elements have a predetermined height so that a predetermined frequency output will be provided by the transducer assembly.

By way of exmaple, it has been found that to develop a frequency of approximately 250 KHz which gives a distance ranging capability to approximately 6 feet, it is desirable to provide the support elements 21 so that they have a size corresponding to a diameter of approximately 20 microns and having a height of approximately 10 microns and a spacing of approximately 200 microns. The support elements 21 correspond to a tent poles which serve to suspend the metalized foil element 16 above the metal surface 13 by a known predetermined distance.

A process for making the support elements 21 from an insulating material may now be briefly described.

A suitable photoresist is placed on the horizontal substantially planar surface 13 of the piston or metallic disc 12 by suitable means such as a syringe. The piston 12 is placed in a machine which is utilized for spinning the piston at a suitable speed as, for example, 5000 revolutions per minute for a few seconds in order to spread the photoresist uniformly over the top substantially planar surface 13 and also to provide a photoresist layer of a predetermined thickness as, for example, approximately 10 microns. After the photoresist has been spun to the desired thickness, the photoresist is baked in a conventional manner by baking the same for approximately 30 minutes at a temperature range of approximately 60° C. Baking the photoresist turns the photoresist into a relatively hard plastic-like surface on top of the substantially planar surface 13. The photoresist is then exposed through a mask assembly having a desired pattern therein. Typically, this can be done in a contact printer in which the photoresist is exposed to ultraviolet through the mask.

Typically, the mask can be formed by utilizing a glass plate having a black surface thereon which is provided with clear holes having the size of the support elements 21 as, for example, a diameter or width of 20 microns and being spaced apart a suitable distance as, for example, 200 microns center to center from each other. Either a positive or negative resist can be used to create the same topography.

After the photoresist has been exposed, the photoresist can be developed by a photoresist developer which serves to remove all of the photoresist which was not exposed to ultraviolet light. After the development has been completed, all of the photoresist has been removed except the portions which were exposed to the ultraviolet light so that there remains on the surface 13 the support elements 21. These support elements will have a height equal to the thickness of the photoresist layer and will have a size, for example, of 20 microns in diameter and will be spaced apart by a suitable distance as, for example, 200 microns. As is well known to those skilled in the art, negative and positive photoresists and developers can be used to obtain the same topography.

The formation of the support elements 21 in this manner is particularly desirable because the sidewalls of the support elements are substantially vertical and are not undercut, thereby making a stronger support. After this operation has been completed, the foil 16 of the transducer assembly can be placed over the support elements 21 in such a manner so that the metal layer on the surface faces away from the support elements 21. In this way it can be seen that the metal layer carried by the foil 16 is spaced apart by insulating support elements 21 from the metal planar surface 13.

An alternative process for making the support elements by chemical milling may now be briefly described. A thin layer of photoresist is applied to the disk with a syringe and it is then spun on a suitable spinning machine to create a thin coating of photoresist having a thickness which is not critical. The disk is then baked in an oven to cure the photoresist. The disk is then exposed with an ultraviolet lamp with a mask, typically clear and black on glass. Next, the disk is developed in a suitable developer to remove unwanted photoresist and baked again to further harden the photoresist. After baking, the disk is immersed in an etching solution typically consisting of phosphoric acid for approximately two minutes and then rinsed in water to stop the reaction. The undesired photoresist is then removed with a liquid stripping agent such as acetone. The resulting pattern is a substantially planar metallic disk surface with metallic protrusions or support elements 21 extending outwardly as shown in FIGS. 1 and 2, the height of which depends upon the acidic action of the phosphoric acid. Factors affecting the heights of the protrusions are time, temperature, disk alloy and concentration of the phosphoric acid which can be varied in a manner well known to those skilled in the art to obtain support elements 21 of the desired heights and cross-sectional area.

It should be appreciated that although a particular pattern is shown in FIGS. 1 and 2 of the drawings for the support elements 21 that other patterns can be utilized. For example, in place of the cylindrical support elements 21 there can be provided a plurality of stripes. These could be in any form or could be rectangular or a plurality of spaced apart stripes.

Operation of the tranducer assembly 11 in apparatus of the type disclosed in copending application Ser. No. 532,576 filed on Sept. 15, 1983 is similar to that therein described. The application of a voltage to the transducer assembly 11 creates an electrical field between the two metal surfaces 13 and 16 separated by the insulated support elements 21. When the voltage is applied, the activated electric field will cause the metal layer 18 carried by the foil 16 to droop down in between the support elements 21. As soon as the voltage is removed from the transducer assembly, the foil 16 will restore itself and jump forward away from the substantially planar surface 13. However, this jumping away will be limited because of the air which is trapped beneath the foil 16 and between the foil 16 and the surface 13. Thus, a reduced pressure type condition will be created which will limit the amount which the foil 16 can jump away from the surface 13. Thus, it can be seen that as a voltage is applied to the transducer assembly 11 at a predetermined frequency, for example, 250 kilohertz, the foil 16 will now move in accordance with the supplied voltage to create ultrasonic energy of this frequency.

Kapton film is utilized because it is relatively strong and and can survive high temperatures. Gold is utilized for the metal layer because it is inert chemically and is relatively tough.

From the foregoing construction it can be seen that the foil 16 is suspended and supported away from the metal substantially planar surface 13 by the use of the support elements 21 which have relatively planar surfaces.

Although the support elements 21 have been shown as being formed on the substantially planar surface of the piston, it should be appreciated if desirable, the support elements 21 can be formed on the foil. By the process of the present invention, it is possible to control the pattern height and the spacing of the support elements. The transducer assembly has a construction which can be easily manufactured.

What is claimed is:

1. In an ultrasonic transducer assembly, a cylindrical element having a planar surface formed of a conducting material, an insulating foil element having first and second surfaces overlying the planar surface of the cylindrical element, the foil element having a conducting layer carried by the first surface and a plurality of spaced apart support elements formed of an insulating material disposed between the planar surface of the cylindrical element and the second surface of the foil whereby when an electric field is applied between the conducting layer of the foil element and the planar surface of conducting material of the cylindrical element, the foil element will move toward and away from the spaced apart support elements at a predetermined frequency in accordance with the applied voltage to create ultrasonic energy at this frequency.

2. An assembly as in claim 1 wherein said support elements are formed of a photoresist.

3. A transducer assembly as in claim 1 wherein said support elements have planar surfaces which lie in a plane generally parallel to the plane of the planar surface of the piston and have sidewalls which extend generally at right angles to the planar surfaces of the support elements.

4. In a method for forming a transducer by utilizing a metallic cylindrical element having a planar surface, polishing the planar surface so that it has a smoothness with peaks and valleys of less than 1 micron, applying a photoresist to the planar surface, baking the photoresist, exposing the photoresist to ultraviolet light through a pattern, developing the photoresist, removing portions of the photoresist so that there remains a plurality of spaced apart support elements having planar surfaces and side walls extending at right angles to the planar surfaces and positioning a foil element having a conducting layer so that it overlies the support elements and is capable of moving in a direction perpendicular to the support elements as a voltage is applied between the cylindrical element and the foil to creat ultrasonic energy.

5. A method as in claim 4 wherein the developing is carried out by the use of a photoresist developer.

6. A method as in claim 4 wherein the developing step is carried out by the use of an acid followed by rinse and wherein the removing step is carried out by the use of a liquid stripping agent.

* * * * *